US007260969B2

(12) United States Patent
Del Fabro et al.

(10) Patent No.: US 7,260,969 B2
(45) **Date of Patent: *Aug. 28, 2007**

(54) BENDING MACHINE FOR PROFILES AND RELATIVE BENDING METHOD

(75) Inventors: Giorgio Del Fabro, Tricesimo (IT); Marcello Del Fabro, Tavagnacco (IT)

(73) Assignee: M.E.P. Macchine Elettroniche Piegatrici SpA, Reana del Rojale (UD) (IT)

( * ) Notice: Subject to any disclaimer, the term of this patent is extended or adjusted under 35 U.S.C. 154(b) by 487 days.

This patent is subject to a terminal disclaimer.

(21) Appl. No.: 10/483,965

(22) PCT Filed: Jul. 18, 2002

(86) PCT No.: PCT/IB02/02798

§ 371 (c)(1),
(2), (4) Date: Jan. 16, 2004

(87) PCT Pub. No.: WO03/008128

PCT Pub. Date: Jan. 30, 2003

(65) Prior Publication Data

US 2004/0187540 A1 Sep. 30, 2004

(30) Foreign Application Priority Data

Jul. 19, 2001 (IT) ..... UD2001A0126

(51) Int. Cl.
*B21D 7/022* (2006.01)
*B21D 11/12* (2006.01)

(52) U.S. Cl. ..... 72/294; 72/307

(58) Field of Classification Search ..... 72/307, 72/306, 294, 149, 159, 388
See application file for complete search history.

(56) References Cited

U.S. PATENT DOCUMENTS

| | | | | |
|---|---|---|---|---|
| 4,000,636 | A * | 1/1977 | Shubin et al. | 72/173 |
| 5,136,871 | A * | 8/1992 | Lisec | 72/294 |
| 5,285,671 | A | 2/1994 | Del Fabro et al. | |
| 5,355,708 | A * | 10/1994 | Kauffman | 72/294 |
| 5,375,447 | A | 12/1994 | Del Fabro et al. | |
| 5,394,725 | A * | 3/1995 | Lisec | 72/294 |
| 6,260,395 | B1 * | 7/2001 | Webster | 72/149 |
| 6,295,857 | B1 | 10/2001 | Rupoli | |
| 7,004,003 | B2 * | 2/2006 | Del Fabro et al. | 72/294 |

FOREIGN PATENT DOCUMENTS

| | | |
|---|---|---|
| EP | 0258109 | 3/1988 |
| EP | 0538595 | 4/1993 |

(Continued)

*Primary Examiner*—Daniel C. Crane
(74) *Attorney, Agent, or Firm*—Stevens, Davis, Miller & Mosher, LLP

(57) ABSTRACT

Bending machine for profiles in the form of bars sheared to size, including at least a drawing assembly, shearing apparatus and bending apparatus. At least part of the drawing assembly is movable between a first loading position, wherein it is upstream of and remote from the bending apparatus to take at least one of the bars sheared to size from an accumulation site, and a second drawing position, wherein it is upstream of and in proximity with the bending apparatus to draw/feed at least one bar towards the shearing apparatus and the bending apparatus and to cooperate with the shearing apparatus and the bending apparatus in performing the bending cycle.

20 Claims, 3 Drawing Sheets

FOREIGN PATENT DOCUMENTS

| | | |
|---|---|---|
| EP | 0592798 | 4/1994 |
| EP | 0865842 | 9/1998 |
| FR | 2553314 | 4/1985 |
| FR | 2704784 | 11/1994 |
| GB | 1413143 | 11/1975 |

* cited by examiner

BENDING MACHINE FOR PROFILES AND RELATIVE BENDING METHOD

This application is a 371 of PCT/IB02/02798, filed Jul. 18, 2002.

FIELD OF THE INVENTION

The present invention concerns a bending machine for profiles, already sheared to size, such as for example round pieces for reinforcement purposes or suchlike, of the type comprising at least a drawing assembly, shearing means and bending means; the invention also concerns the connected bending method.

At least part of the drawing assembly of the bending machine according to the present invention is movable from a first loading position, wherein it is remote from the bending means, to a second drawing position wherein it is in proximity with said drawing means.

In the first loading position, the movable part of the drawing assembly is able to pick up the already sheared to size profile from an accumulation site, while in the second drawing position the drawing assembly is able to make the profile advance in order to perform the bending cycle.

The invention is applied particularly for bending and shaping straight bars able to form stirrups or other shaped elements for reinforcement purposes.

BACKGROUND OF THE INVENTION

There are known bending machines for profiles already sheared to size, such as round pieces for reinforcement purposes or suchlike, individual or in bundles, wherein the drawing assembly is stationary and positioned in proximity with the shearing means, such as for example a shears, and bending means, such as for example a rotary bending disk including at least a bending pin and at least an axial contrasting pin.

The nearness of the drawing assembly to the bending means is due to the fact that, among other reasons, the sheared to size straight bars have longitudinal tensions and torsions which are released with the action of bending, making the bar rotate on its longitudinal axis as it advances. This has a negative effect on the quality, precision and planarity of the bends themselves and on the final products obtained.

It is therefore extremely advantageous to limit to a minimum the segment of bar not gripped between the drawing assembly and the shearing or bending means.

At the same time the nearness of the drawing assembly to the bending means makes the operator responsible for loading the machine more exposed to the danger of accidents and injury; in fact, in order to load the profiles into the drawing assembly, for example by removing them from a bundle, the operator has to be very near the shearing means and the bending means, with the risk of being hit by shavings, fragments or the profile itself during the bending step.

Moreover, since the torsions of the bar are released as it advances and is bent, the bent portion can rise up for quite a large amount from the ideal bending plane, with the risk of hitting the operator.

Documents EP-A-0.258.109, GB-A-1.413.143 and FR-A-2.553.314 all refer to shearing and/or bending machines which work metal bars from a coil; they comprise a drawing element movable with alternate motion, with continuous backwards and forwards movements, to unroll on each occasion a desired segment of said metal bars which are wound in a coil and to feed them to the relative machine.

In the machines described in these documents, there is always a straightening assembly between the feeding coil and the drawing assembly; thanks to the action of the straightening assembly, the problems of longitudinal tensions and torsions, which are found in the bending of pre-sheared bars, are largely eliminated.

The Applicant is not aware of bending machines which work pre-sheared profiles and which have at least part of the drawing assembly movable from a first loading position cooperating with an accumulation site for the profiles to a second drawing position wherein they cooperate with the bending unit and with the shearing assembly in order to perform the bending cycle.

The Applicant has devised and embodied the present invention to overcome this shortcoming of the state of the art and to obtain further advantages.

SUMMARY OF THE INVENTION

The present invention is set forth and characterized in the main claims, while the dependent claims describe other innovative characteristics of the invention.

The purpose of the invention is to achieve a bending machine for profiles already sheared to size, and a relative method, which will allow the operator to load said machine with said profiles while standing in a position sufficiently removed from the bending means so that he does not run the risk of accidents during the shearing and bending steps.

Another purpose is to reduce the risk that the residual torsions present in the straight bars to be bent are released during the feed and bending operations, prejudicing the precision and quality of the bends.

A further purpose is to reduce to a minimum the rotation of the bars on their own axis during feed.

Another purpose is to obtain an increase in productivity.

The bending machine on which the present invention is applied comprises at least a drawing assembly able to draw at least one profile, already sheared to size, such as for example a straight bar for reinforcement purposes or suchlike, shearing means able to finish the size of said profiles in order to perform the desired reinforcement element, and bending means able to bend the profiles to make stirrups or other shaped products.

According to a characteristic feature of the present invention, at least part of the drawing assembly is movable between a first loading position, wherein it is remote from the shearing means and bending means in order to be loaded with at least one profile in cooperation with a site wherein said profiles are accumulated, and a second drawing position wherein it is substantially in proximity with and upstream of the shearing means and bending means to draw/feed the loaded profile towards the latter and to cooperate with them in performing the bending cycle.

In this second drawing position, the drawing assembly is able to feed the profile step-wise, in conventional manner, to perform the usual bending operations on the leading end; or the profile can be made to advance for a pre-set length, gripped by a second drawing assembly, arranged downstream of the bending means, sheared and then moved step-wise to perform the trailing end bends.

In a first embodiment, the drawing assembly comprises a driver of the type with one or more pairs of rollers, and is assembled on a trolley movable between the said two positions, respectively the loading and drawing positions.

During the passage between said two positions, the rollers of the driver grip on the profile with a pincer effect; this prevents the profile itself from rotating on its own axis, thus allowing to obtain perfectly parallel bends.

In a second embodiment, the drawing assembly comprises at least a gripping member, such as a pincer or suchlike, movable between the two positions, loading and drawing, to selectively take the profiles from a loading position remote from the bending unit and transfer them, preventing them from rotating on their own axis, onto a roller-type driver arranged upstream of and in proximity with said bending unit.

In another embodiment, the drawing assembly is formed by two or more gripping members, such as pincers or similar, of which one is movable between the loading position and the drawing position, and one is stationary arranged upstream of the bending unit, cooperating with each other so as to load and draw the profiles.

In another embodiment, the drawing assembly comprises a roller-type driver arranged upstream of or in proximity with the bending unit, and pincer means which can also be moved beyond the bending unit, in order to transfer the profile without rotation from the bending means to the second drawing assembly suitable to perform the trailing end bends.

According to a variant, in cooperation with said second drawing assembly there is at least a retaining element which limits the raising of the profile during bending to a minimum value.

With the bending machine as described heretofore, the operator can position himself sufficiently remote from the shearing means and bending means, since it is the drawing assembly, or at least a part of it, which moves from a loading zone, where the operator can position himself, to a drawing zone in proximity with the shearing means and bending means.

With the invention therefore the safety of the operator is facilitated, and in any case, during the drawing/feeding steps, the drawing assembly is kept in a position near the bending unit. Moreover, in the first advance step of the profile the drawing assembly acts thereon with a pincer effect, thus preventing axial rotations and torsions of the profile.

BRIEF DESCRIPTION OF THE DRAWINGS

These and other characteristics of the present invention will be apparent from the following description of some preferential forms of embodiment, given as a non-restrictive example with reference to the attached drawings wherein.

DETAILED DESCRIPTION OF SOME PREFERENTIAL FORMS OF EMBODIMENT OF THE INVENTION

Figure 1:
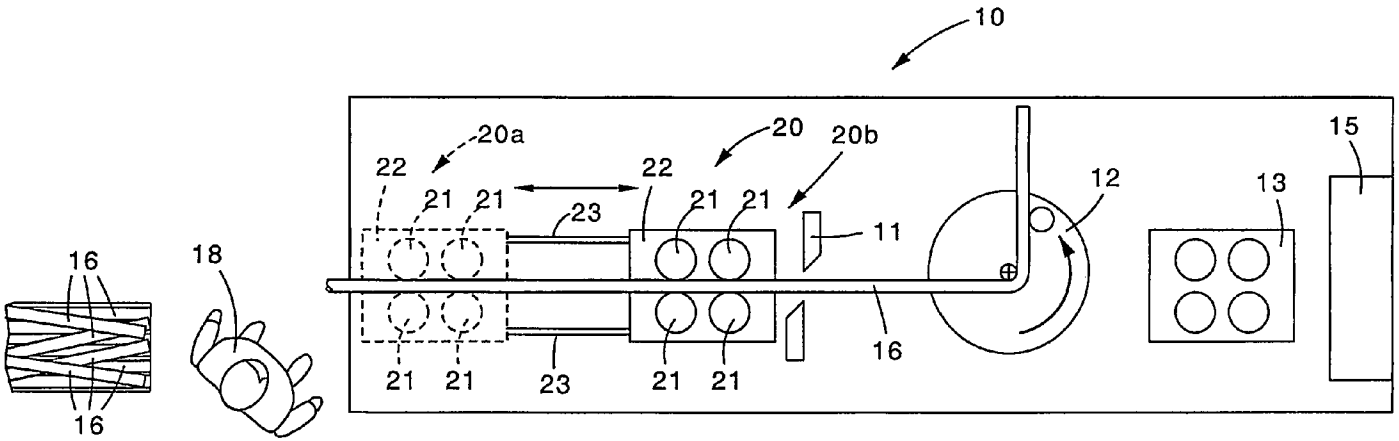
FIG. 1 is a schematic view from above of a bending machine according to the invention, in a first embodiment.

With reference to FIG. 1, a bending machine 10 for profiles 16 already sheared to size, in particular a straight bar, is shown in a first form of embodiment and comprises in succession a leading end drawing assembly 20, a shears 11, a rotary disk bending unit 12, a trailing end drawing assembly 13, possibly retractable, and a retaining element 15 able to prevent the bent segments of the profile 16 from rising up with respect to an ideal plane as the bending operations proceed.

In a first embodiment shown in FIG. 1, the leading end drawing assembly 20 comprises a driver with two pairs of rollers 21, assembled on a trolley 22. Said trolley 22 can slide on two guides or tracks 23 and is movable between a first loading position 20*a* (shown by dashes in FIG. 1), wherein an operator 18 responsible for loading the profiles 16 can position himself, in cooperation with a site wherein said profiles 16 are accumulated, and a second drawing position 20*b* (shown by a continuous line in FIG. 1) wherein it is in proximity with the shears 11 and the bending unit 12.

The movement of the drawing assembly 20 allows the operator 18 to assume an operating position sufficiently remote from the shears 11 and the bending unit 12 so as to ensure optimum safety conditions.

In the passage from the first 20*a* to the second 20*b* position, the rollers 21 are stationary and grip on the profile 16, achieving a pincer effect which prevents harmful rotations on the axis of the profile 16.

When the drawing assembly 20 has moved to the drawing position 20*b*, the profile 16 is made to advance in conventional manner, by the rotation of the rollers 21 and said drawing assembly cooperates with the bending unit 12 in performing the shearing cycle.

Figure 4:
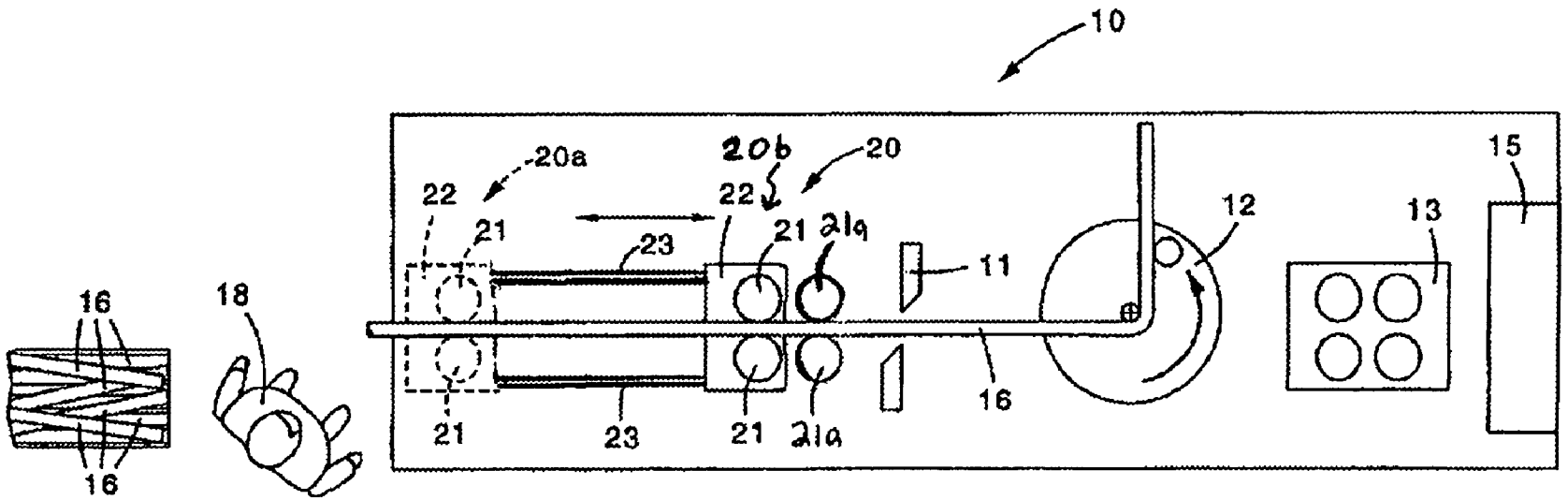
FIG. 4 is a schematic view of yet another embodiment according to the invention.

FIG. 4 shows an embodiment within the field of the invention wherein the driver comprises at least a pair of rollers 21 movable between the drawing and loading positions 20*a*, 20*b* and one or more pairs of fixed rollers 21*a* upstream of the shears 11 and the bending unit 12.

In this case, when the moveable pair of rollers 21, after having taken the profile 16 and located it between the rollers 21*a* of the fixed pair, performs its return movement to the loading position 20*a*, the pair of fixed rollers 21*a* can begin the drawing/feeding procedure to perform the bending. This embodiment entails an increase in productivity and a reduction in the dead time.

In a second embodiment (FIG. 2) of the machine 10 according to the present invention, the drawing assembly is indicated by the number 120 and is substantially composed of a driver with two pairs of rollers 121 fixed with respect to the machine 10, and a gripper member 122, such as for example a pincer, assembled able to slide on a guide 123. The pincer 122 is movable between a loading position 122*a* (shown by dashes in FIG. 2), wherein an operator 18 responsible for loading the profiles 16 can position himself, and a drawing position 122*b* (shown by a continuous line in FIG. 2), wherein it is in proximity with the driver with rollers 121 which cooperates with the bending unit 12 to perform the shearing cycle. After having released the profile 16 between the rollers 121, said pincer 122 returns to the loading position to allow the driver 120 to draw/feed the profile 16 in conventional manner.

In this case too it is possible to obtain an increase in productivity because, having received the profile 16, the driver 120 can work during the return movement of the pincer 122 to the loading position 122*a*.

Figure 2:
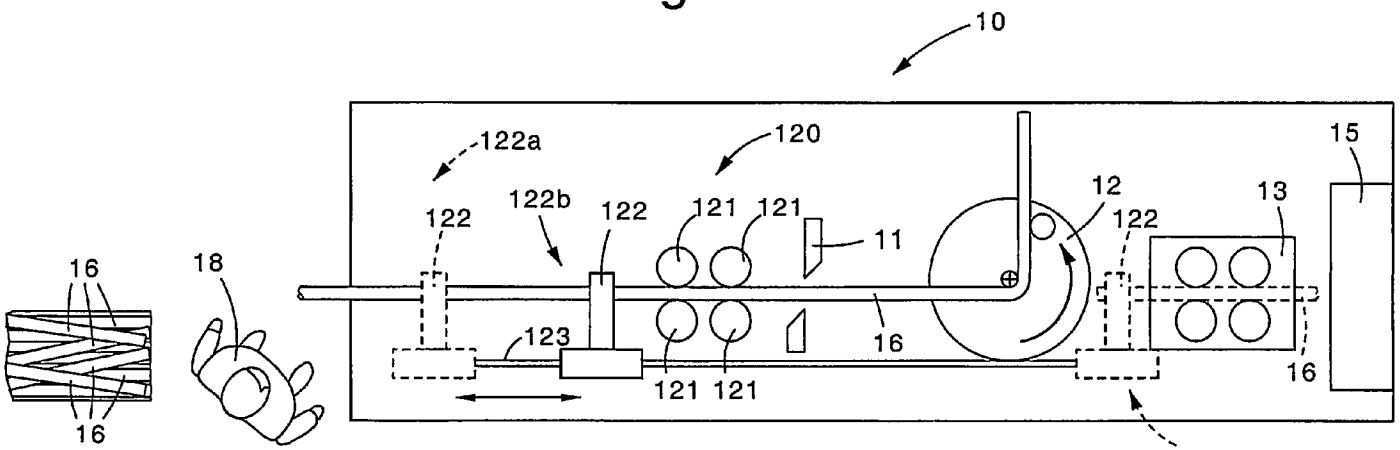
FIG. 2 is a schematic view from above of a bending machine according to the invention, in a second embodiment.

According to a variant to this embodiment, indicated by dashes in FIG. 2, the pincer 122 can move to a third position 122*c*, arranged downstream of the bending unit 12, to draw the profile 16 without it rotating on its axis, and to transfer it to the trailing end drawing assembly 13 to perform the trailing end bends.

Figure 3:
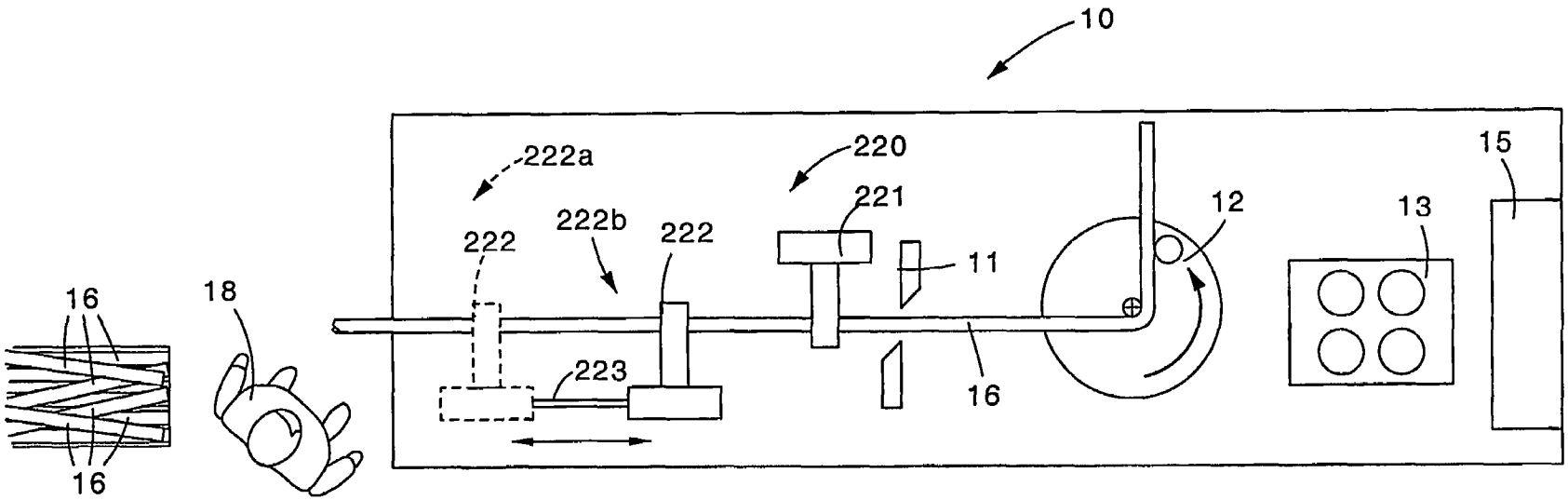
FIG. 3 is a schematic view from above of a bending machine according to the invention, in a third embodiment.

In a third embodiment (FIG. 3), the drawing assembly is indicated by the number 220 and comprises a first fixed pincer 221 arranged in proximity with the bending unit 12 and a second pincer 222 arranged upstream of first pincer 221 and assembled able to slide on a guide 223. The pincer 222 is able to move alternately between a loading position 222*a* (shown by dashes in FIG. 3), wherein it is suitable to take at least one profile 16, and a drawing position 222*b* (shown by a, continuous line in FIG. 3), wherein it is in proximity with the bending unit 12 and is able to deliver the profile 16 to the first pincer 221.

In this last embodiment the task of the pincer 222 is both to feed the profile 16 towards the bending unit 12, in co-operation with the pincer 221, and also to feed it forwards step-wise, beyond the bending unit 12, during the bending steps.

At the start of the bending operations, the movable part of the drawing assembly is positioned in the respective first loading position (20*a*, 122*a*, 222*a*). In this position, the operator 18 can remove one or more profiles 16 from the bundle and insert them between the gripping elements of the drawing assembly, staying far enough away from the shears 11 and the bending unit 12.

Then, said movable part translates and makes said profile 16 advance, exerting thereon a pincer effect which prevents it from rotating, and moves to the second drawing position (20*b*, 122*b*, 222*b*) from which, in substantially usual procedures, the bending operations can be started. In the event that trailing end bends are to be made, the profile 16 will be fed forwards for a length and sheared by the shears 11; at this point the drawing assembly 13 moves to the gripping position and draws the profile 16 backwards so that the desired bending can be done.

It is obvious however that modifications and/or additions of parts can be made to the machine 10 and method as described heretofore without departing from the spirit and scope of the present invention.

For example, according to a variant, downstream of the driver a pair of expulsion rollers are provided, to manage the discharge of the off-cuts.

It is also obvious that, although the present invention has been described with reference to specific examples, a skilled person in the art shall certainly be able to achieve many other equivalent forms of bending machine for profiles and relative bending method, all of which shall come within the field and scope of the present invention.

The invention claimed is:

1. Bending machine for profiles in the form of bars sheared to size, comprising at least a drawing assembly, shearing means, and bending means, wherein at least part of said drawing assembly comprises rollers and is movable between a first loading position and a second drawing position, wherein in the first loading position said part is upstream of and remote from said bending means and located for taking at least one of said sheared to size bars from a site wherein said bars are accumulated, and wherein in the second drawing position said part is upstream of and in proximity with said bending means and said part is stationary while the rollers are rotatable for feeding said at least one bar towards said shearing means and said bending means and said part is stationary for cooperating with said shearing means and bending means in performing a bending cycle.

2. Machine as in claim 1, wherein said drawing assembly comprises a driver with pairs of said rollers associated with trolley means movable between said first loading position and said second drawing position.

3. Machine as in claim 2, wherein said trolley means are able to slide axially on at least a guide or track.

4. Machine as in claim 2, wherein during the passage from said first position to said second position the rollers of said drawing assembly are fixed for exerting a pincer effect on the profile, for preventing the profile from rotating on its axis.

5. Machine as in claim 1, wherein the machine comprises at least a retaining element for preventing the bent portion of said profile from rising up.

6. Bending method for profiles, wherein at least one profile cooperates with a drawing assembly to be fed linearly to shearing means and bending means, comprising:

moving at least a movable part of said drawing assembly comprising rollers, at the start of a bending cycle, to a first position located upstream of and remote from said bending means, picking up at least a profile from an accumulation site and loading said profile onto said movable part of said drawing assembly, translating said movable part of the drawing assembly to a second position located upstream of and in proximity with said shearing means, and then, while said movable part remains stationary in said second position, said rollers rotate to feed said profile so that the bends are made by said bending means.

7. Method as in claim 6, wherein said movable part of the drawing assembly is moved downstream of said bending means to transfer said profile to a trailing end drawing assembly located downstream of said bending means.

8. Bending machine for profiles in the form of bars sheared to size, comprising at least:

a drawing assembly comprising at least a first part and a second part, shearing means, and bending means, wherein at least said first part is movable, between a first position and a second position, for feeding said at least one of said bars sheared to size towards said second part, said shearing means, and said bending means, wherein in the first position said first part is upstream of and remote from said second part, said shearing means, and said bending means, and located for taking said at least one of said sheared to size bars from a site wherein said bars are accumulated, wherein in the second position said first part is upstream of and in proximity with said second part, said shearing means, and said bending means, wherein said second part is fixed upstream of and in proximity with said bending means, and wherein said second part comprises means for engaging said at least one of said bars sheared to size and for cooperating with said shearing means and bending means in performing a bending cycle, wherein the cooperating comprises holding said at least one of said bars sheared to size during bending.

9. Machine according to claim 8, wherein said first part comprises pincer means.

10. Machine according to claim 9, wherein said second part comprises a member of the group consisting of pincers and rollers.

11. Machine according to claim 8, wherein said second part comprises a member of the group consisting of pincers and rollers.

12. Machine as in claim 8, wherein the machine comprises at least a retaining element for preventing the bent portion of said profile from rising up.

13. Machine as in claim 8, wherein said drawing assembly comprises a driver with two or more pairs of rollers, wherein said first part comprises at least one first pair of said rollers movable from said first loading position to said second drawing position, and wherein said second part comprises at least one second pair of said rollers fixed in proximity with and upstream of said bending means and rotatable for feeding the at least one of the bars sheared to size towards the shearing means and the bending means.

14. Machine as in claim 8, wherein said drawing assembly second part comprises a fixed driver with rollers, arranged upstream of and in proximity with said bending means, and said first part comprises pincer means movable between said first loading position and said second drawing position.

15. Machine as in claim 14, comprising a trailing end drawing assembly arranged downstream of the bending means, wherein said pincer means are moveable to a position arranged downstream of said bending means to transfer said profile to said trailing end drawing assembly.

16. Machine as in claim 8, wherein said drawing assembly second part comprises first fixed pincer means arranged upstream of and in proximity with said bending means, and said first part comprises at least second pincer means movable between said first loading position and said second drawing position.

17. Bending method for profiles, wherein at least one profile cooperates with a drawing assembly to be fed linearly to shearing means and bending means, comprising:

moving at least a first part of said drawing assembly, at the start of a bending cycle, to a first position located upstream of and remote from said bending means, picking up at least a profile from an accumulation site and loading said profile onto said first part of said drawing assembly, translating said first part of the drawing assembly, loaded with the profile, to a second position located upstream of and in proximity with a second part of the drawing assembly, said shearing means and said bending means, then said second part engages the profile so that the bends are made by said bending means during a bending cycle, wherein said second part is stationary and in proximity to said shearing means and said bending means and cooperates with said shearing means and bending means in performing the bending cycle, wherein the cooperating comprises holding said at least one of said bars sheared to size during bending.

18. Method according to claim 17, wherein said first part comprises pincer means.

19. Method according to claim 18, wherein said second part comprises a member of the group consisting of pincers and rollers.

20. Method according to claim 18, wherein said second part comprises a member of the group consisting of pincers and rollers.

* * * * *